United States Patent [19]

Tanaka

[11] Patent Number: 4,955,115

[45] Date of Patent: Sep. 11, 1990

[54] BUCKLE DEVICE

[75] Inventor: Kohbun Tanaka, Niwa, Japan

[73] Assignee: Kabushiki Kaisha Tokai-Rika-Denki-Seisakusho, Aichi, Japan

[21] Appl. No.: 378,045

[22] Filed: Jul. 11, 1989

[30] Foreign Application Priority Data

Jul. 11, 1988 [JP] Japan ..... 63-91758
Jul. 13, 1988 [JP] Japan ..... 63-92940

[51] Int. Cl.[5] ..... A44B 11/25
[52] U.S. Cl. ..... 24/641; 24/637
[58] Field of Search ..... 24/641, 637, 643, 644, 24/648, 653

[56] References Cited

U.S. PATENT DOCUMENTS 3,242,546 3/1966 Fisher ..... 24/637
3,790,994 2/1974 Jakob ..... 24/637
4,677,716 7/1987 Monsigny ..... 24/641
4,736,497 4/1988 Escaravage ..... 24/641

FOREIGN PATENT DOCUMENTS 62-28888 7/1987 Japan .
62-28889 7/1987 Japan .
2010955 7/1979 United Kingdom ..... 24/641

*Primary Examiner*—Victor N. Sakran
*Attorney, Agent, or Firm*—Oliff & Berridge

[57] ABSTRACT

A buckle device in which a lock plate is moved by an urging force to be brought into engagement with a tongue plate or, in the state of engagement with the tongue plate, it is moved against the urging force by the operation of a release button to be disengaged from the tongue plate. Stoppers are provided which can be selectively moved during engagement of the tongue plate between inhibition positions, at which they inhibit the above operation of the operation member and also inhibit the lock plate from moving in the direction of movement for disengaging from the tongue plate, and allowance positions at which they allow the above operation of the operation member and also allow the lock plate to disengage from the tongue plate. When maintained at the inhibition position, the stoppers prevent the operation of the operation member and disengagement of the lock plate and the tongue plate.

19 Claims, 14 Drawing Sheets

50
H
F
38C
38A
38B
38
34B
34C
34C
34A
C
D
J
38D
K
E
34
34B
28
34A
34
22

BUCKLE DEVICE

BACKGROUND OF THE INVENTION

1. Field of the Invention

This invention relates to a buckle device for use in a seat belt apparatus.

2. Description of Related Art

Ordinarily, this kind of buckle device has a structure in which a lock plate is moved by an urging force of a lock spring to be brought into engagement with a tongue plate or, in a state of engagement with the tongue plate, it is moved against the urging force of the lock spring by the operation of a release button to be disengaged from the tongue plate.

In buckle devices of this type, a portion of the release button is exposed outside the buckle cover for enabling the operation. There is therefore a risk of a portion of the body of the occupant or a certain object striking against the release button and accidentally moving the same and, hence, a risk of the lock plate from moving against the urging force of the lock spring by this movement of the release button, this movement, resulting in disengagement from the tongue plate. With a view to solving this problem, a type of buckle device (such as those disclosed in Japanese Utility Model Publication Nos. 62-28888 and 62-28889) has been proposed which has a stopper separately provided to restrict the movement of the release button. After the tongue plate has been engaged, the stopper is moved to prevent the release button from moving to the tongue plate releasing position.

In this type of buckle device, however, there is also a risk of the lock plate moving against the urging force of the lock spring and disengaging from the tongue plate if a large force to move the lock plate is caused by a large acceleration applied to the lock plate in the tongue plate releasing direction. In consideration of this risk, it is necessary to set a large urging force for the lock spring.

SUMMARY OF THE INVENTION

In consideration of these facts, it is an object of the present invention to provide a buckle device capable of inhibiting an operational member such as a release button from moving to the tongue plate releasing position during engagement of the tongue plate, and also capable of simultaneously inhibiting the lock plate from moving to a position of disengagement from the tongue plate.

To this end, the present invention provides a buckle device capable of locking a tongue plate inserted into the buckle device, and capable of allowing the tongue plate to be drawn out by releasing the tongue plate from the locked state, the buckle device including:

a lock member capable of swinging between a first position at which it engages with the tongue plate in a path for insertion of the tongue plate to lock the same, and a second position at which it is displaced out of the tongue plate insertion path to allow the tongue plate to be drawn out;

an urging means for urging the lock member toward the first position;

an operation member for displacing, by a moving operation, the lock member against the urging force of the urging means from the first position to the second position to disengage the tongue plate and the lock member from each other;

a first stopper member selectively moved between a third position at which it allows the moving operation of the operation member, and a fourth position at which it inhibits the moving operation of the operation member; and a second stopper member moved in a linked relationship with the first stopper member, the second stopper member being positioned out of a path for swinging of the lock member to enable the lock member to swing from the first position to the second position when the first stopper member is placed at the third position, the second stopper member being positioned in the swinging path of the lock member to inhibit the lock member from swinging from the first position to the second position when the first stopper member is placed at the fourth position.

In this arrangement of the present invention, the first stopper member functions to inhibit the operation of the operation member by being moved to the fourth position after the tongue plate has been engaged with the buckle device. Simultaneously, the second stopper member enters in the path for swinging of the lock member to render the lock member unable to swing from the first position to the second position.

Consequently, in a tongue plate engagement state in which the first stopper has been moved to the fourth position after engagement of the tongue plate, the operation member is prevented from moving and allowing disengagement of the lock member from the tongue plate even if a portion of the body of the occupant or a certain object strikes against the operation member, and the lock member is also prevented from moving in the direction of movement for disengaging from the tongue plate even if any large acceleration is applied to the lock member toward the second position.

If, in this tongue plate engagement state, the first stopper member is moved to the third position, the operation of the operation member is enabled. Simultaneously, the second stopper is displaced by the movement of the first stopper out of the path for swinging of the lock member, thereby allowing the lock member to move to the second position.

Consequently, if the operation member is operated in order to disengage the tongue plate and the lock member from each other after the first stopper member has been moved to the third position, the lock member is moved against the urging force of the urging means, thereby enabling disengagement of the tongue plate and the lock member.

Thus it is possible to prevent the lock member and the tongue plate from being accidentally disengaged, and there is no need for increasing the force of the urging means for urging the lock member.

BRIEF DESCRIPTION OF THE DRAWINGS

FIG. 1 is a cross-sectional view of a disengaged state of a tongue plate;

FIG. 2 is a cross-sectional view of an engaged state of the tongue plate in association with FIG. 1;

FIG. 3 is a cross-sectional view of essential portions taken along the line 3—3 of FIG. 2;

FIG. 4 is an exploded perspective view of essential portions of a structure including a lock plate and a block;

FIG. 5 is a cross-sectional view of essential portions taken along the line 5—5 of FIG. 2;

FIG. 6 is a cross-sectional view of essential portions taken along the line 6—6 of FIG. 1;

FIG. 7 is a perspective view of the whole of the device;

FIG. 8 is a cross-sectional view of essential portions corresponding to FIG. 5;

FIG. 9 is an exploded perspective view of essential portions corresponding to FIG. 4;

FIG. 10 is a perspective view of the whole of the device corresponding to FIG. 7;

DESCRIPTION OF THE PREFERRED EMBODIMENTS

Referring to FIGS. 1 to 7, a buckle device 1 which represents a first embodiment of the present invention is illustrated.

Figure 1:
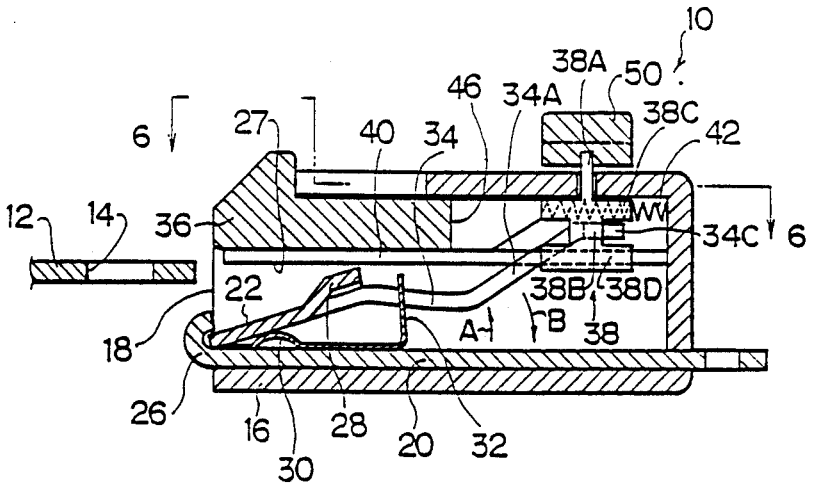
FIGS. 1 to 7 show a buckle device which represents a first embodiment of the present invention.
Figure 2:
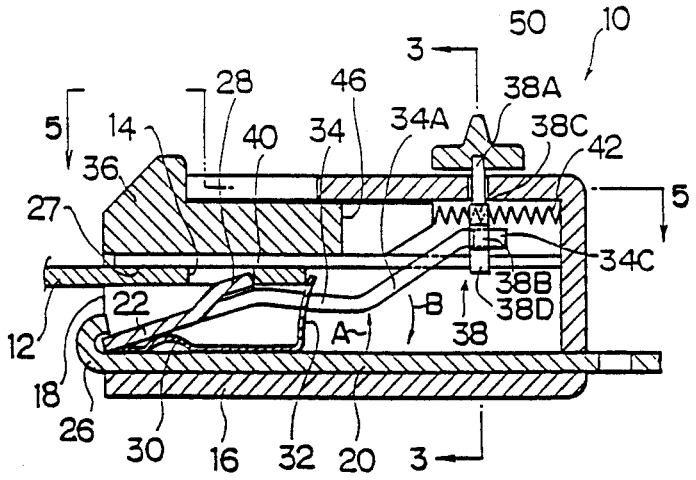

As shown in FIGS. 1 and 2, the buckle device 1 can receive a tongue plate 12 which is inserted in and engaged with the buckle device 1. The tongue plate 12 has an engagement hole 14 for engagement with the buckle device 10. The engagement hole 14 is formed in a portion of the tongue plate 12 which is inserted into the buckle device 10.

The buckle device 10 has a buckle cover 16 in which an opening 18 is formed. The top end of the tongue plate 12 is passed through the opening 18 when the tongue plate 12 is inserted in the buckle device 10. A buckle body 20 is retained inside the buckle cover 16.

The buckle body 20 is a member in the form of a plate which extends inside the buckle cover 16 along a bottom wall (the inner bottom wall as viewed in FIG. 1 or 2) of the buckle cover 16. The buckle body 20 has a receiving portion 26 formed by bending the end facing the direction in which the tongue plate is drawn out (on the left-hand side of FIG. 1 or 2) so as to have a circular arc profile. A lock plate 22 is retained inside the buckle cover 16 by being fitted to the receiving portion 26 so as to be swingable about its portion fitted to the receiving portion 26.

The lock plate 22 is a member in the form of a plate which extends from the portion fitted to the receiving portion 26 in the direction of insertion of the tongue plate (to the right as viewed in FIG. 1 or 2). The lock plate 22 has an engagement projection 28 which is formed on the side of an end portion of the lock plate 22 which is opposite to the portion fitted to the receiving portion 26 and faces in the direction of insertion of the tongue plate (to the right as viewed in FIG. 1 or 2), the engagement projection 28 being formed generally at the center of the lock plate 22 with respect to the widthwise direction thereof (perpendicular to the plane of projection of FIG. 1 or 2). The engagement projection 28 projects toward a tongue plate insertion path 27 and faces the engagement hole 14 of the tongue plate 12 when the tongue plate is inserted. As the lock plate 22 swings about its portion fitted to the receiving portion 26, the engagement projection 28 enters the engagement hole 14 of the tongue plate 12 while facing the same, as shown in FIG. 2, thereby engaging with the tongue plate 12. The engagement projection 28 is disengaged from the tongue plate by being drawn out of the engagement hole 14 of the tongue plate 12.

A plate spring 30 for urging the lock plate 22 in the direction of engagement with the tongue plate 12 (indicated by the arrow A in FIG. 1 or 2) is disposed between the lock plate 22 and the buckle body 20. When the lock plate 22 is swung in a tongue plate releasing direction (indicated by the arrow B in FIG. 2), it is moved against the urging force of the plate spring 30. The plate spring 30 has a raised portion 32 which projects into the tongue plate insertion path 27. The raised portion 32 is capable of being bent by being pressed against the tongue plate 12 at the time of insertion of the same and pressing the same in the tongue plate drawing out direction (to the left as viewed in FIG. 1 or 2) while the tongue plate 12 is in the engaged state.

The lock plate 22 has a pair of projections 34 which are formed on opposite sides with respect to the widthwise direction (perpendicular to the plane of projection of FIG. 1 or 2) and at its end portion which is opposite to the portion fitted to the receiving portion 26 and which faces in the tongue plate insertion direction (to the right as viewed in FIG. 1 or 2). Above the projections 34 is mounted a release button 36 which is a release operation member, and a block 38 which provides first and second stoppers.

The projections 34 are bent at their extensionintermediate portions and have operating arms 34A and engagement portions 34B. The operating arms 34A are formed in the vicinity of the extreme ends of the projections 34 facing in the direction of extension so as to extend generally in the tongue plate insertion direction (to the right as viewed in FIG. 1 or 2) and to intersect a prolongation of the tongue plate insertion path in the vicinity of their extension-extreme ends when placed at a position for engagement with the tongue plate (the position indicated in FIG. 1 and 2). The engagement portions 34B are formed continuously with the operating arms 34A so as to extend along the tongue plate insertion direction. The engagement portions 34B have extension lugs 34C which are formed at their extreme ends and which extend so as to be closer to each other.

Figure 5:
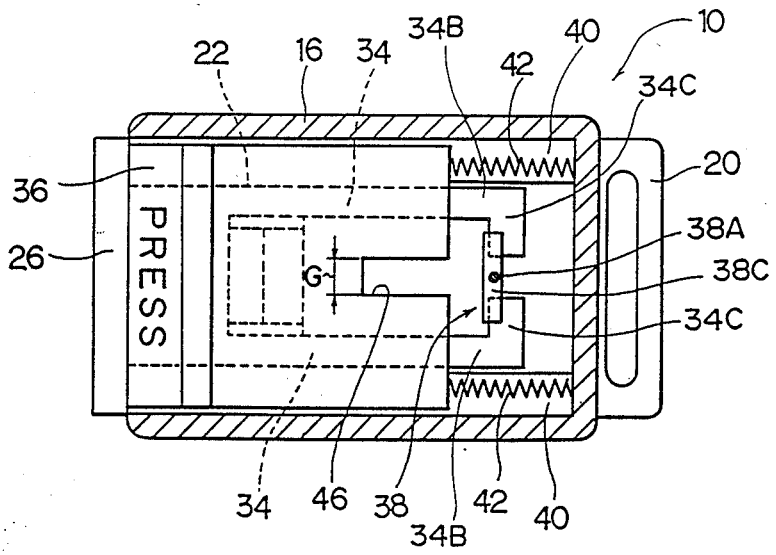
Figure 6:
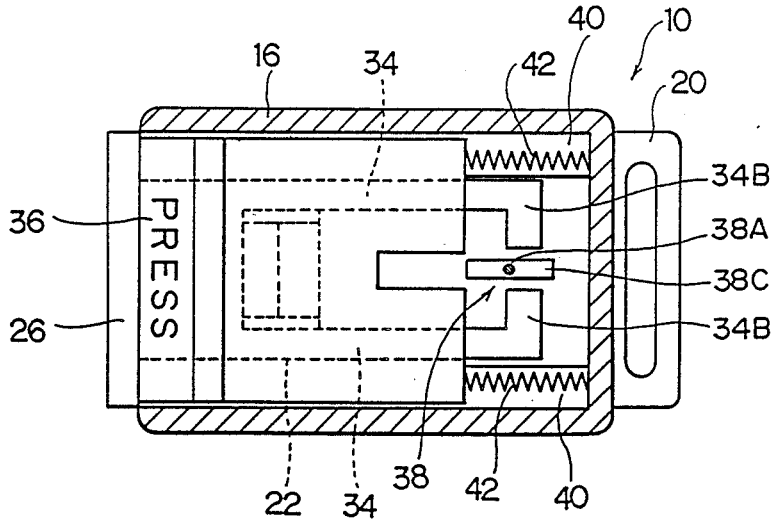

The release button 36 is disposed between an upper wall of the buckle cover 16 (the inner top wall as viewed in FIG. 1 or 2) and a pair of guide plates 40 disposed generally parallel to this upper wall, so as to be movable in the tongue plate insertion/drawing-out direction (to the left or right as viewed in FIG. 1 or 2). An end face of the release button 36 facing in the tongue plate insertion direction (to the right as viewed in FIG. 1 or 2) is opposed to the operating arms 34A of the projection 34. As the release button 36 is moved in the tongue plate insertion direction, it can press the operating arms 34A by this end portion to make the lock plate 22 swing to a position at which the lock plate is disengaged from the tongue plate 12. The pair of guide plates 40 are provided on side walls of the buckle cover 16 opposite to each other in the widthwise direction (perpendicular to the plane of projection of FIG. 1 or 2) (refer to FIGS. 3 and 7). The operating arms 34A of the projections 34 pass through a space between the pair of guide plates 40 and are partially positioned between the guide plates 40 and the upper wall of the buckle cover 16 (the inner top wall as viewed in FIG. 1 or 2) so that the end face of the release button 36 facing in the tongue plate insertion direction (to the right as viewed in FIG. 1 or 2) is opposed to the operating arms 34A of the projections 34. The release button 36 has a portion exposed outside of the buckle cover 16 facing the tongue plate drawing out direction (on the left-hand side of FIG. 1 or 2) and can be moved in the tongue plate insertion direction (to the right as viewed in FIG. 1 or 2) by an operation of pressing this exposed portion. A pair of release springs 42 are provided between the release button 36 and the buckle cover 16 on opposite sides with respect to the widthwise direction (perpendicular to the plane of projection of FIG. 1 or 2), as shown in FIGS. 5 and 6. The pair of release springs 42 urge the release button 36 in the tongue plate drawing out direction (to the left as viewed in FIG. 1 or 2). The release button 36 is moved in the tongue plate insertion direction (to the right as viewed in FIG. 1 or 2) against the urging force of the release springs 42.

A cutout 46 is formed in an end portion of the release button 36 on the side facing the tongue plate insertion direction (on the right-hand side of FIG. 1 or 2) and generally at the center of the release button 36 with respect to the widthwise direction (perpendicular to the plane of projection of FIG. 1 or 2), as also shown in FIGS. 5 and 6. The cutout 46 serves to provide clearance for the block 38.

Figure 4:
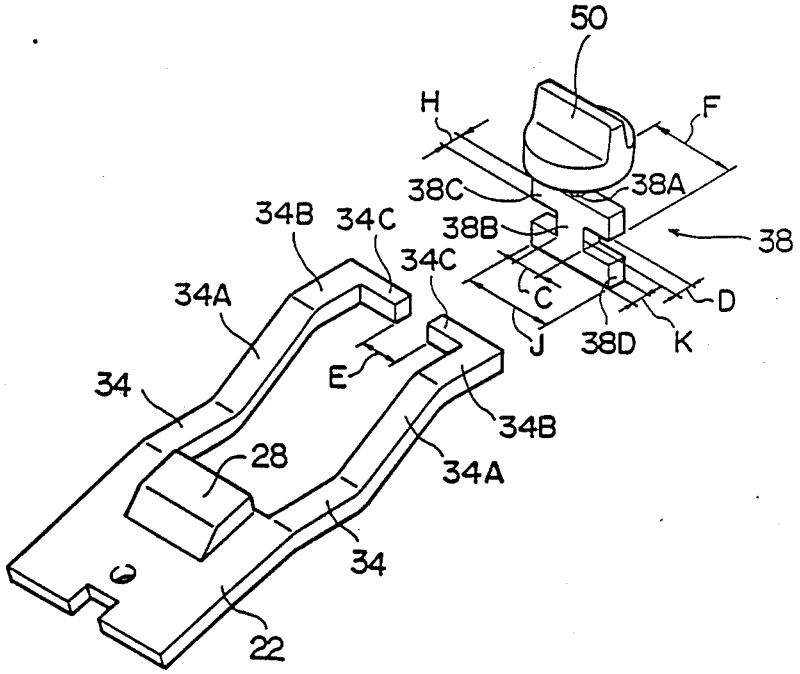

The block 38 has a small-diameter shaft portion 38A connected to its main body portion. The small-diameter shaft portion 38A is axially and rotatably supported on an upper wall portion of the buckle cover 16 (the wall portion on the top as viewed in FIG. 1 or 2) with the main body disposed under the upper wall of the buckle cover 16. The main body of the block 38 has a construction in which parallel plate portions 38C and 38D which serve as first and second stoppers are connected by a connecting plate portion 38B so that the block 38 has an H-shaped configuration in elevation, as shown in FIG. 4. The block 38 is rotated about the small-diameter shaft portion 38A to selectively set the longitudinal direction of the parallel plate portions 38C and 38D to the tongue plate insertion/drawing-out direction (parallel to the plane of projection of FIG. 1 or 2) or to the direction perpendicular to the tongue plate insertion/drawing-out direction (perpendicular to the plane of projection of FIG. 1 or 2).

The connecting plate portion 38B is located between the extension lugs 34C of the engagement portions 34B of the lock plate 22 when the lock plate 22 is in the position for engagement with the tongue plate 12 (in the position indicated in FIGS. 1 and 2). Both the width C and the thickness D of the connecting plate portion 38B (shown in FIG. 4) are smaller than the distance E between the extension lugs 34C of the engagement portions 34B (as shown in FIG. 4), thereby enabling the block 38 to rotate while avoiding interference with the lock plate 22 irrespective of the rotational position about the small-diameter shaft portion 38A.

The parallel plate portion 38C faces the cutout 46 of the release button 36, as shown in FIGS. 5 and 6. The length F (shown in FIG. 4) of the parallel plate portion 38C is larger than the width G (shown in FIG. 5) of the cutout 46 of the release button 36, and the width H (shown in FIG. 4 of the parallel plate 38C is smaller than the width G of the cutout 46 of the release button 36. When, as shown in FIGS. 1 and 6, the parallel plate portion 38C is in a rotational position at which the longitudinal direction thereof is adjusted to the tongue plate insertion/drawing-out direction (parallel to the plane of projection of FIG. 1 or 5), the parallel plate portion 38C enters the cutout 46 of the release button 36 as the release button 36 is moved for operation, thereby allowing the release button 36 to be moved to a tongue plate releasing position (a position at which release button 36 places the lock plate 22 in the tongue plate releasing position). When, as shown in FIGS. 2 and 5, the parallel plate position 38C is in the rotational position at which the longitudinal direction thereof is adjusted to the direction perpendicular to the tongue plate insertion/drawing-out direction, both the lengthwise-end portions of the parallel plate portion 38C contact the end of the release button 36 facing in the tongue plate insertion direction (to the right as viewed in FIG. 2 or 6) if the release button 36 is moved for operation, thereby inhibiting the release button 36 from moving to the tongue plate releasing position (a position at which the release button 36 places the lock plate 22 in the tongue plate releasing position).

Figure 3:
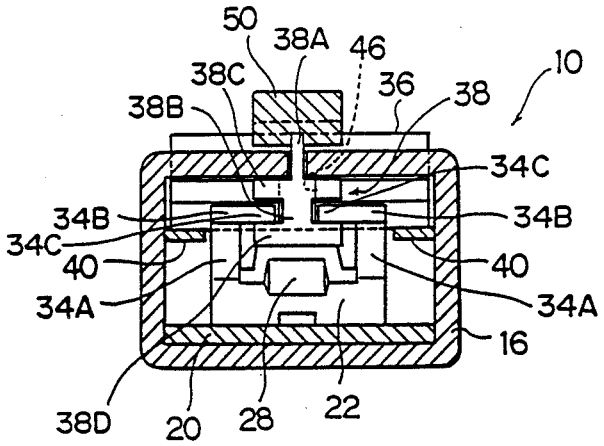

The parallel plate portion 38D faces the extension lugs 34C of the engagement portions 34B of the lock plate 22, as shown in FIG. 3, when the lock plate 22 is in the position for engagement with the tongue plate 12 (indicated in FIGS. 1 and 2). The length J (shown in FIG. 4) of the parallel plate portion 38D is larger than the distance E (shown in FIG. 4) between the extension lugs 34C of the engagement portions 34B of the lock plate 22. When the parallel plate portion 38D is in the rotational position at which the longitudinal direction thereof is adjusted to the direction perpendicular to the tongue plate insertion/drawing-out direction, the parallel plate portion 38D contacts the extension lugs 34C of the engagement portions 34B of the lock plate 22 if the lock plate 22 is swung in the tongue plate releasing direction (indicated by the arrow B in FIG. 1 or 2), thereby inhibiting the lock plate 22 from moving to the tongue plate releasing position. The width K (shown in FIG. 4) of the parallel plate portion 38D is smaller than the distance E (shown in FIG. 4) between the extension lugs 34C of the engagement portions 34B of the lock plate 22. In consequence, when as shown in FIGS. 1 the parallel plate position 38D is in the rotational position at which the longitudinal direction thereof is adjusted to the tongue plate insertion/drawing-out direction, the parallel plate portion 38D enters the space between the extension lugs 34C of the engagement portions 34B of the lock plate 22, thereby allowing the lock plate 22 to swing to the tongue plate releasing position.

Figure 7:
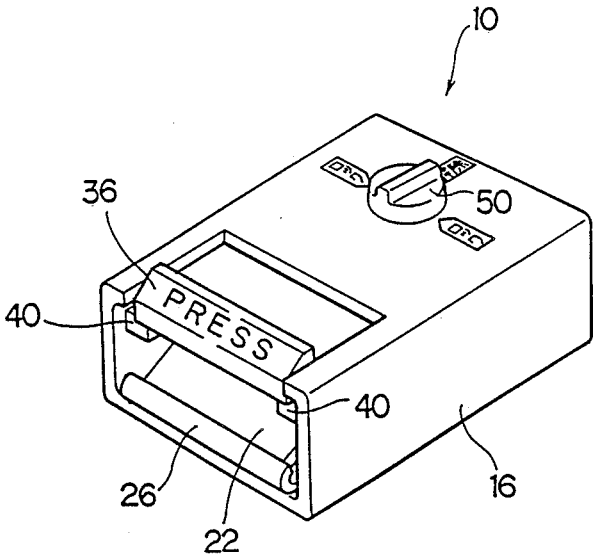

The block 38 has a knob 50 fixed to the top end of the small-diameter shaft portion 38A. The block 38 can be rotated about the small-diameter portion 38A from the outside of the buckle cover 16 by operating the knob 50 of the block 38. As shown in FIG. 7, characters read as "Lock", "Release" and "Lock" are displayed around a portion of the buckle cover 16 at which the knob is attached, thereby indicating the position of the parallel plate portions 38C and 38D selected from the position at which the longitudinal direction of these portions corresponds to the tongue plate insertion direction (parallel to the plane of projection of FIG. 1 or 2) or to the direction perpendicular to the tongue plate insertion direction (perpendicular to the plane of projection of FIG. 1 or 2.

The operation of this embodiment will be described below.

FIG. 1 shows a state in which the buckle device 10 is released from the tongue plate 12 by drawing the same out of the buckle device 10. In this state, the lock plate 22 is urged by the plate spring 30 to be set to the position for engagement with the tongue plate 12. Also, the longitudinal direction of the parallel plate portions 38C and 38D of the block 38 is adjusted to the tongue plate insertion/drawing-out direction (parallel to the plane of projection of FIG. 1). In this state, therefore, the release button 36 can be moved to the tongue plate releasing position (at which it places the lock plate in the tongue plate releasing position) by allowing the parallel plate portion 38C to enter the cutout 46 of the release button 36 during the movement of the release button 36. At the same time, the lock plate 22 can swing to the tongue plate releasing position by allowing the parallel plate portion 38D to enter the space between the extension lugs 34C of the engagement portions 34B of the lock plate 22 during swinging of the same in the tongue plate releasing direction.

To engage the tongue plate with the buckle device, the tongue plate 12 is inserted through the opening 18 of he buckle cover 16. During insertion, the front end of the tongue plate 12 is brought into contact with the engagement projection 28 of the lock plate 22 and presses the same so as to swing the lock plate 22 in the tongue plate releasing direction (indicated by the arrow B in FIG. 1). When, during this insertion, the engagement hole 14 faces the engagement projection 28 of the lock plate 22, the lock plate is swung in the tongue plate engaging direction (indicated by the arrow A in FIG. 1) by being urged by the plate spring 30, and the engagement projection 28 enters the engagement hole 14 of the tongue plate 12, thus bringing the buckle device 10 and the tongue plate 12 into engagement with each other (refer to FIG. 2).

The raised portion 32 of the plate spring 30 is bent by the insertion of the tongue plate 12 for engagement. In the engaged state of the tongue plate 12, therefore, the tongue plate 12 is urged in the drawing-out direction by the urging force of the raised portion 32 of the plate spring 30.

If in this state the block 38 is rotated by an rotational operation of the knob 50 so that as shown in FIG. 2 the longitudinal direction of the parallel plate portions 38C and 38D is adjusted to the direction perpendicular to the tongue plate insertion/drawing-out direction (or perpendicular to the plane of projection of FIG. 2), the parallel plate portion 38C is brought into contact with the release button 36 when the release button 36 is moved for operation, thereby rendering the release button 36 unable to move to the tongue plate releasing position. Simultaneously, at the time of swinging of the lock plate 22 in the tongue plate releasing direction, the parallel plate portion 38D is brought into contact with the extension lugs 34C of the engagement portions 34B of the lock plate 22, thereby rendering the lock plate to 22 unable to swing to the tongue plate releasing position.

Consequently, in the engaged state of the tongue plate 12 shown in FIG. 2 in which the block 38 is rotated after the tongue plate 12 has been engaged with the lock plate 22, the release button 36 is prevented from moving to the tongue plate releasing position even if a portion of the body or a certain object strikes against the release button 36, and the lock plate 22 is also prevented from moving to the tongue plate releasing position even if any large acceleration is applied to the lock plate 22 in the tongue plate releasing direction.

To release the tongue plate 12, the block 38 is rotated by rotational operation of the knob 50 so that the longitudinal direction of the parallel plate portions 38C and 38D is adjusted to the tongue plate insertion/drawing-out direction (parallel to the plane of projection of FIG. 2, and the parallel plate portion 38C enters the cutout 46 of the release button 36 when the release button 36 is moved for operation, thereby allowing the release button 36 to move to the tongue plate releasing position (the position at which the release button 36 places the lock plate 22 in the tongue plate releasing position). Simultaneously, at the time of swinging of the lock plate 22 in the tongue plate releasing direction, the parallel plate portion 38D enters the space between the extension lugs 34C of the engagement portions 34B, thereby allowing the lock plate 22 to swing to the tongue plate releasing position. If the release button 36 is thereafter operated by being pressed and moved in the tongue plate insertion direction (to the right as viewed in FIG. 2), the lock plate 22 moves in the tongue plate releasing direction (indicated by the arrow B in FIG. 2) against the urging force of the plate spring 30 by this movement of the release button 36, and the engagement projection 28 of the lock plate 22 is drawn out of the engagement hole 14 of the tongue plate 12. Simultaneously, the tongue plate 12 is moved by the urging force of the raised portion 32 of the plate spring 30 in the drawing-out direction, thereby disengaging the buckle device 10 from the tongue plate 12, as shown in FIG. 1.

Figure 8:
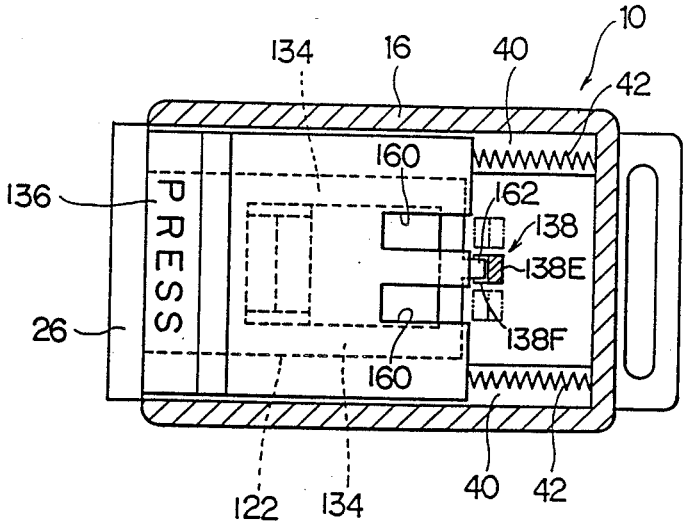
FIGS. 8 to 10 show a buckle device which represents a second embodiment of the present invention.
Figure 9:
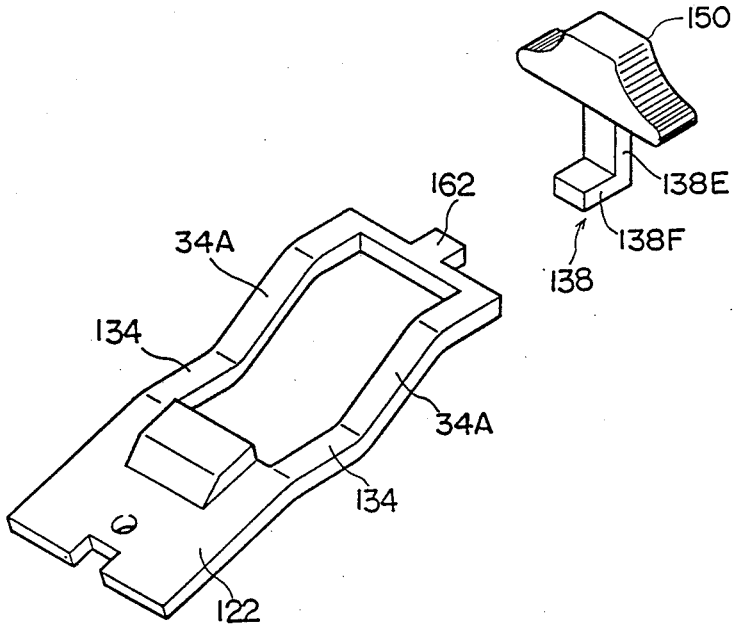
Figure 10:
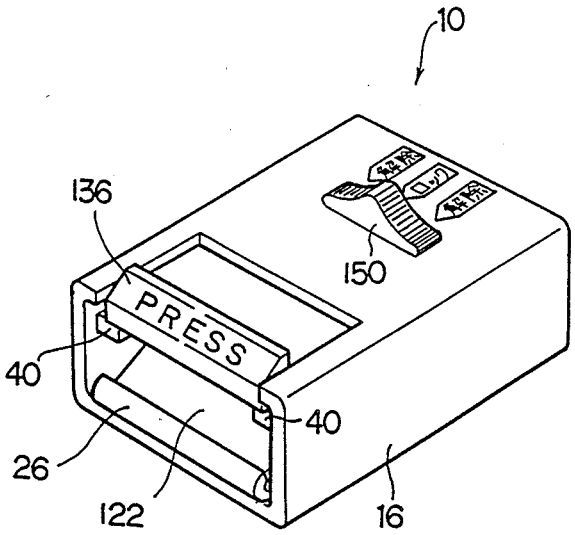

FIGS. 8 to 10 show another buckle device which represents a second embodiment of the present invention. The same reference numerals are used to designate parts which correspond to those in the first embodiment.

In this embodiment, as shown in FIG. 8, a release button 136 has a pair of cutouts 160 formed at its end facing toward the tongue plate insertion direction (on the right-hand side of FIG. 8). As shown in FIG. 9, projections 134 of a lock plate 122 are connected to each other at the projecting end from which an engagement lug 162 extends in the tongue plate insertion direction. A block 138 is moved by the operation of a knob 150 (shown in FIGS. 9 and 10) in the direction perpendicular to the tongue plate insertion/drawing-out direction (toward the top or bottom of FIG. 8). The block 138 is generally L-shaped and has a long-side portion 138E and a short-side portion 138F. The long-side portion 138E can face each cutout 160 of the release button 136 or the portion between the cutouts 160 during the movement in the direction perpendicular to the tongue plate insertion/drawing-out direction (toward the top or bottom of FIG. 8). When made to face one of the cutouts 160 of the release button 136, the long-side portion 138E enters the cutout 160 as the release button 136 is moved, thereby allowing the release button 136 to move to the tongue plate releasing position (the position at which the release button places the lock plate 122 in the tongue plate releasing position). When made to face the portion of the release button 136 between the cutouts 160, the long-side portion 138E abuts against the release button 136 as the release button 136 is moved, thereby inhibiting the release button 136 from moving to the tongue plate releasing position. The short-side portion 138F faces the engagement lug 162 of the lock plate 122 when the long-side portion 38E is positioned to face the portion of the release button 136 between the cutouts 160. If, in this state, the lock plate 122 moves to swing in the tongue plate releasing direction, the short-side portion 138F abuts against the engagement lug 162 and inhibits the lock plate 122 from swinging to the tongue plate releasing position. When the longside portion 138E is positioned to face one of the cutouts 160 of the release button 136, the short-side portion 138F is deviated from the position at which it faces the engagement lug 162, thereby allowing the lock plate 122 to swing to the tongue plate releasing position. Consequently, in this embodiment also, in the engaged state of the tongue plate 12 in which the block 138 is moved after the tongue plate 12 has been engaged with the lock plate 122, the release button 136 is rendered unable to move to the tongue plate releasing position and is thus prevented from moving to this position even if a portion of the body of the occupant or a certain object strikes against the release button 136. Also, the lock plate 122 is rendered unable to move to the tongue plate releasing position and is thus prevented from moving to this position even if any large acceleration is applied to the lock plate 122 in the tongue plate releasing direction.

A third embodiment of the present invention will be described below with reference to FIGS. 11 to 16.

A buckle device 210 applied to a seat belt apparatus to fit around an occupant of a vehicle includes a buckle body 212 and a tongue plate 214 inserted in the buckle body 212.

The buckle body 212 has a buckle case 216 in the form of a box and a frame 218 fixed to the buckle case 216.

A webbing (not shown) is attached to one end of the tongue plate 214. An engagement hole 220 for engagement with the buckle body 212 is formed in an intermediate portion of the tongue plate 214.

The buckle case 216 has an insertion/drawing-out opening 222 which is formed in its one side surface (on the left-hand side of FIG. 11) and through which the tongue plate 214 is inserted or drawn out, and a guide 224 for laterally guiding the tongue plate 214. The guide 224 is formed on an inner wall of the buckle case 216 and can slide on the upper surface of the tongue plate 214 to guide the same when the tongue plate 214 is inserted through the insertion/drawing-out opening 222. The buckle case 216 also has a rectangular operation hole 226 formed in its upper wall portion offset from its center in the tongue plate insertion direction (indicated by the arrow M) (on the right-hand side of FIG. 11).

The frame 218 is in the form of a plate and is disposed inside the buckle case 216 so as to extend along a bottom wall of the buckle case 216. The frame 218 has a receiving portion 228 formed at its one side facing in the tongue plate drawing out direction so as to have a hook-like profile. The end of the frame 218 opposite to the receiving portion 228 extends to the outside by passing through a wall of the buckle case 216 in the tongue plate insertion direction. A through hole 230 is formed in this extension, and one end of a webbing 232 is inserted in this hole and is connected to the frame 218. The other end of the webbing 232 is connected to a vehicle body (not shown), thereby connecting the buckle body 212 to the vehicle body.

A lock member 234 in the form of a plate capable of being engaged with the tongue plate 214 when inserted in the buckle body 212 is disposed inside the buckle case 216 so as to obliquely extend across a tongue plate insertion path or a prolongation of the same. One end of the lock member 234 facing in the tongue plate drawing out direction is fitted in the receiving portion 228 so that the lock member 234 is capable of swinging about its end on the side of the receiving portion. The lock member 234 has its intermediate portion cut and raised to form an engagement projection 236 which is engaged with the engagement hole 220 when the tongue plate 214 is inserted into the buckle body 212. Another end of the lock member 234 facing in the tongue plate insertion direction extends to a position immediately below the operation hole 226 of the buckle case 216, and a generally rectangular flat plate portion 238 is formed at this end. An operation button member 240 in the form of a flat plate to be pressed for operation through the operation hole 226 is fixed to the flat plate portion 238. A projection 242 is formed by cutting and raising an end of the flat plate portion 238 facing in the tongue plate drawing out direction. The projection 242 generally extends in the direction of the tongue plate drawing out direction (the direction opposite to the arrow M).

A plate spring 244 which constitutes an urging device is interposed between the frame 218 and the lock member 234. The plate spring 244 is fixed by being pinched at its one end between the receiving portion 228 of the frame 218 and the mating end of the lock member 234. The plate spring 244 has a bent portion 244A formed by bending perpendicular to the tongue plate insertion/-drawing-out direction an intermediate portion so that this portion protrudes upward, thereby urging the lock member 234 for swinging upward (in the direction of the arrow N) about the end thereof on the side of the insertion/drawing-out opening 222. When the tongue plate 214 is inserted into the buckle body 212, the lock member 234 is first swung downward (in the direction opposite to that of the arrow N) against the urging force of the plate spring 244 but is swung upward by the plate spring 244 when the projection 242 is positioned below the engagement hole 220. The projection 242 thereby engages with the engagement hole 220, thereby inhibiting the tongue plate 214 from being drawn out of the buckle body 212. Another end of the plate spring 244 facing in the tongue plate insertion direction is bent upward to form a raised portion 244B whereby the tongue plate 214 is constantly urged in the direction of drawing out of the buckle body 212 after the tongue plate 214 has been inserted in the buckle body 212.

A lid 246 which is capable of opening or closing the operation hole 226 and which serves as a moving member is generally rectangular in plan view. Side portions of the lid 246 opposite to each other in the direction perpendicular to tongue plate insertion/drawing-out direction (widthwise-end portions) are inserted in grooves 248 formed along the tongue plate insertion/-drawing-out direction in inner walls of the buckle case 216 facing each other, thereby supporting the lid 246 slidably on the buckle case 216. The lid 246 can be moved by being guided along the grooves 248 between a first position (indicated by the double-dot-dash line in FIG. 11) at which it closes the operation hole 226 to inhibit the operation of pressing the operation button member 240, and a second position (indicated by the solid line in FIG. 11) at which it opens the operation hole 226 to allow the operation of pressing the operation button member 240.

An operation projection 250 is formed on the upper surface of the lid 246 so as to extend along the end surface thereof facing in the tongue plate insertion direction. The operation projection 250 is operated to open or close the operation hole 226.

An end portion of the lid 246 opposite to the operation projection 250 extends downward and has its extreme end projected in the tongue plate insertion direction so as to form a hook-like profile, thereby forming a stopper portion 252. The extreme end of the stopper portion 252 is positioned below the projection 242 of the lock member 234 so as to inhibit the lock member 234 from swinging downward (in the direction opposite to the direction of the arrow N). In consequence, if the lid 246 is moved to the first position at the time of engagement between the lock member 234 and the tongue plate 214, the lock member 234 is inhibited from swinging downward, thereby preventing the tongue plate 214 from being disengaged from the buckle body 212.

Figure 15:
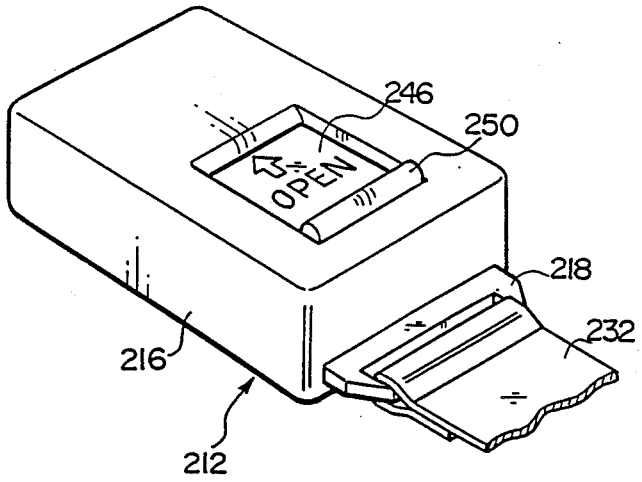
FIG. 15 is a perspective view of the buckle body in a state in which an operation hole is closed.
Figure 16:
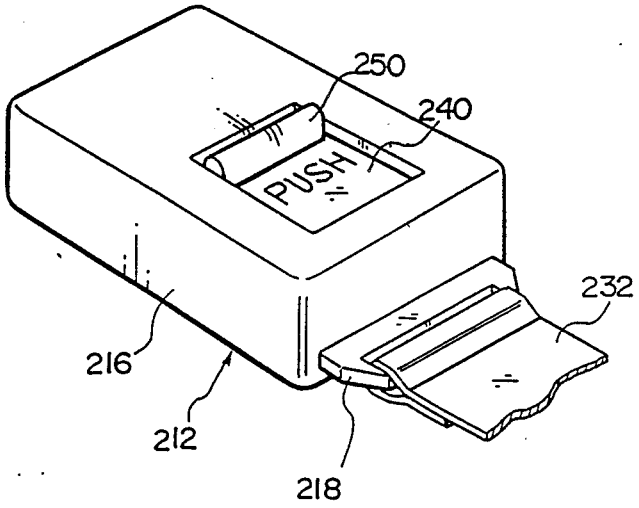
FIG. 16 a perspective view of the buckle body in a state in which the operation hole is open.

Characters read as "OPEN" are displayed on the upper surface of the lid 246, as shown in FIG. 15, while characters read as "PUSH" are displayed on the upper surface of the operation button member 240, as shown in FIG. 16.

The operation of this embodiment will be described below.

A case where the occupant sits on the vehicle seat and applies the seat belt will first be described. The tongue plate 214 is brought into engagement with the buckle body 212 as described below.

Figure 11:
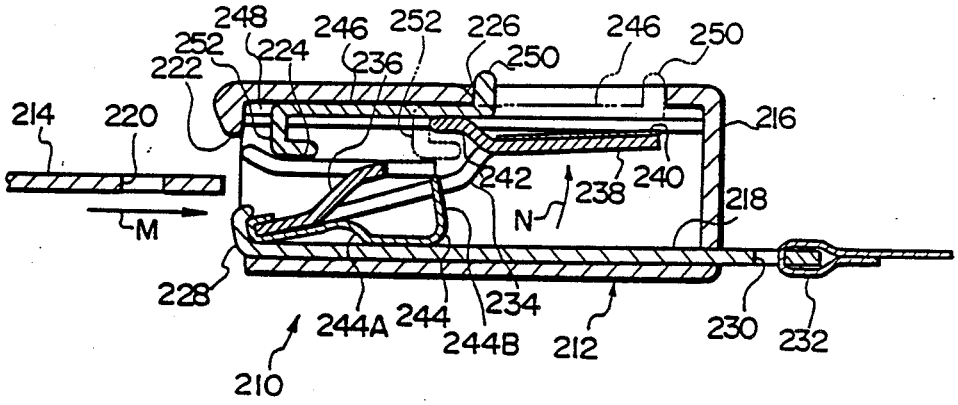
FIG. 11 is a longitudinal sectional view of a buckle device which represents a third embodiment of the present invention, illustrating a state in which a tongue plate and a buckle body are disengaged from each other.

In the state shown in FIG. 11, the tongue plate 214 is move in the direction of the arrow M and is inserted into the buckle case 216 through the insertion/drawing-out opening 222. At this time, the tongue plate 214 advances inside the buckle case 216 while moving the lock member 234 downward against the urging force of the plate spring 244, and the engagement hole 220 and the engagement projection 236 are engaged with each other by the urging force of the plate spring 244 when the tongue plate reaches the predetermined position, which state is thereafter maintained.

Figure 12:
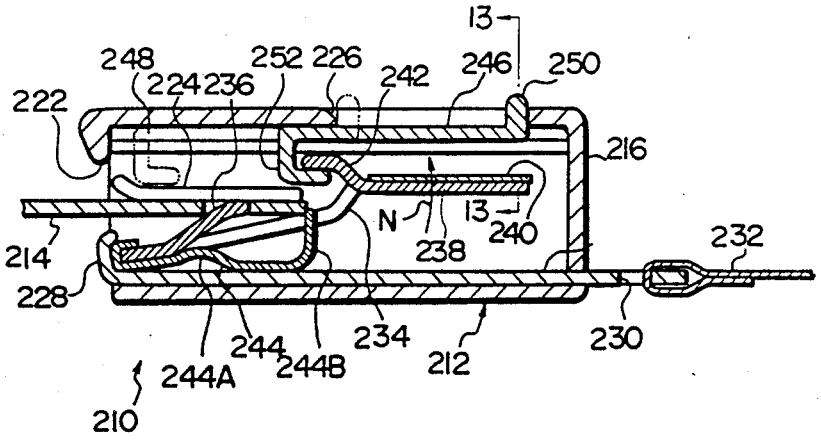
FIG. 12 is a longitudinal sectional view of a state in which the tongue plate and the buckle body shown in FIG. 11 are engaged with each other.
Figure 13:
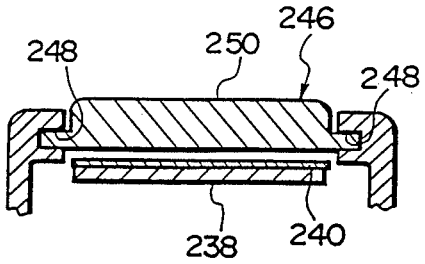
FIG. 13 is a cross-sectional view taken along the line 8—8 of FIG. 12.
Figure 14:
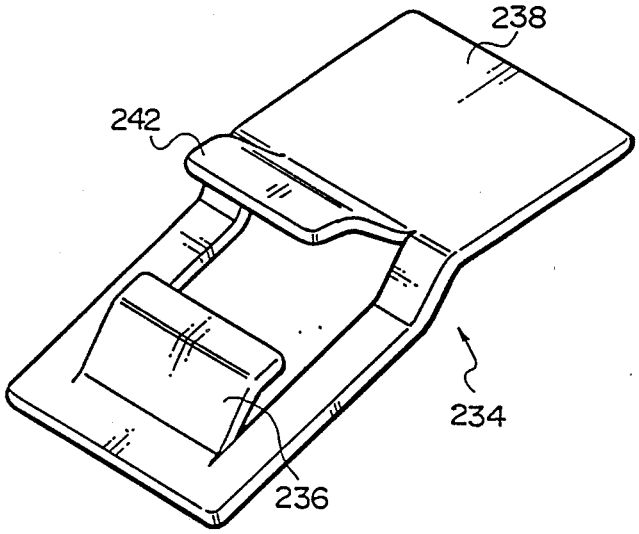
FIG. 14 is a perspective view of a lock member of the third embodiment.

If the lid 246 is thereafter manually moved to the first position, a state such as that shown in FIG. 12 is established in which the operation hole 226 is closed in order to prevent the operation button member from being inadvertently or accidentally pressed.

Also, in this state, the stopper portion 252 of the lid 246 is positioned below the projection 242 of the lock member 234, and the projection 242 can contact the stopper portion 252 to inhibit the lock member 234 from swinging downward if any inertia force is applied to the lock member 234 in the downward direction (in the direction opposite to the direction of the arrow N in FIG. 12) at the time of abrupt vehicle deceleration, thereby preventing the engagement projection 236 of the lock member 234 from coming off the engagement hole 220 of the tongue plate 214, that is, preventing the tongue plate 214 from being disengaged from the lock member 234. It is thus possible to maintain, with reliability, the state of the seat belt applied to the occupant.

Next, a case in which the occupant releases the seat belt from the applied state will be described. The tongue plate 214 and the buckle body 212 are disengaged as described below.

The lid 246 is moved from the first position to the second position by operating the operation projection 250 to open the operation hole 226. Simultaneously, the stopper portion 252 of the lid 246 recedes from the position immediately below the projection 242 of the lock member 234, thereby allowing the lock member 234 to swing downward (in the direction opposite to the direction of the arrow N in FIG. 11). If the operation button member 240 is thereafter pressed through the operation hole 226, the lock member 234 is swung downward (in the direction opposite to the direction of the arrow N in FIG. Il) so that the engagement projection 236 of the lock member 234 moves out of the engagement hole 220 of the tongue plate 214, thereby disengaging the tongue plate from the buckle body 212.

Since in this case the front end of the tongue plate 214 is in contact with the raised portion 244B of the plate spring 244 and is constantly urged in the tongue plate drawing-out direction (opposite to the direction of the arrow M in FIG. 11), the tongue plate 214 is pushed outward in the direction opposite to the direction of the arrow M in FIG. 11 when the engagement projection 236 is moved out of the engagement hole 220.

In this embodiment, the stopper portion 252 is formed integrally with the lid 246, in accordance with the present invention, however, the stopper 252 is not limited to this type and it may be constructed in any other way so long as it is capable of moving in a linked relationship with the lid 246.

What is claimed is:

1. A buckle device capable of locking a tongue plate inserted into the buckle device and capable of allowing said tongue plate to be drawn out by releasing said tongue plate from the locked state, said buckle device comprising:

a lock member capable of swinging between a first position at which it engages with said tongue plate in a path for insertion of said tongue plate to lock the same, and a second position at which it is displaced out of said tongue plate insertion path to allow said tongue plate to be drawn out;

an urging means for urging said lock member toward said first position;

an operation member for displacing, by moving operation, said lock member against the urging force of said urging means from said first position to said second position to disengage said tongue plate and said lock member from each other;

a first stopper member selectively moved relative to said operation member between a third position at which it allows said moving operation of said operation member and a fourth position at which it inhibits said moving operation of said operation member; and a second stopper member moved relative to said lock member in a linked relationship with said first stopper member, said second stopper member being positioned out of a path for swinging of said lock member to enable said lock member to swing from said first position to said second position when said first stopper member is placed at said third position, said second stopper member being positioned in the swinging path of said lock member to inhibit said lock member from swinging from said first position to said second position when said first stopper member is placed at said fourth position.

2. A buckle device according to claim 1, wherein said first and second stopper members are integrally connected to each other.

3. A buckle device according to claim 2, wherein said first stopper member is moved to one of said third position and said fourth position by a rotational operation.

4. A buckle device according to claim 3, wherein said operation member has a recessed portion and a projecting portion formed in its end surface facing in the direction in which said operation member is moved by said moving operation, and said first stopper member has a mating portion mating with said recessed and projecting portions, said mating portion facing said recessed portion of said operation member in said third position to allow said moving operation of said operation member, said mating portion facing said projecting portion of said operation member in said fourth position to inhibit said moving operation of said operation member.

5. A buckle device according to claim 4, wherein said lock member has a recessed portion operably associated in the direction of swinging of said lock member with said second stopper member when said first stopper member is placed in said third position, whereby said second stopper member is positioned out of the swinging path of said lock member.

6. A buckle device according to claim 2, wherein said first stopper member is moved between said third position and said fourth position by a sliding operation in a direction generally perpendicular to the direction of insertion of said tongue plate and generally parallel to the plane of the insertion path.

7. A buckle device according to claim 6, wherein said operation member has a recessed portion and a projecting portion formed in its end surface facing in the direction in which said operation member is moved by said moving operation, and said first stopper member has a mating portion mated with said recessed and projecting portions, said mating portion facing said recessed portion of said operation member in said third position to allow said moving operation of said operation member, said mating portion facing said projecting portion of said operation member in said fourth position to inhibit said moving operation of said operation member.

8. A buckle device according to claim 7, wherein said lock member has a projection, and said second stopper member has a contact portion which is positioned out of a path for swinging of said projection of said lock member to allow said lock member to swing from said first position to said second position when said first stopper member is placed in said third position, and which is positioned in the path for swinging of said projection of said lock member to inhibit said lock member from swinging from said first position to said second position when said first stopper member is placed in said fourth position.

9. A buckle device according to claim 2, wherein said first stopper member is formed of a lid member which exposes an operational portion of said operation member to allow said moving operation of said operation member when placed in said third position, and which covers said operational portion of said operation member to inhibit said moving operation of said operation member when placed in said fourth position.

10. A buckle device according to claim 9, wherein said second stopper has an extension which extends from said lid member, which is positioned out of a path for swinging of said lock member when said lid member is placed in said third position, and which is positioned in the path for swinging of said lock member when said lid member is placed in said fourth position.

11. A buckle device capable of locking and unlocking a tongue plate inserted into a buckle device, comprising:

a buckle case in which said tongue plate can be inserted and from which said tongue plate can be drawn out;

a lock plate disposed inside said buckle case and capable of swinging between an engagement position at which it engages with said tongue plate to lock the same when said tongue plate is inserted into said buckle case and a disengagement position at which it is disengaged from said tongue plate;

an urging means for urging said lock plate toward said engagement position;

an operation member for displacing, by a moving operation, said lock plate against the urging force of said urging means to said disengagement position to disengage said tongue plate and said lock plate from each other;

a first stopper selectively moved relative to said operation member between an allowance position at which it allows said moving operation of said operation member, and an inhibition position at which it inhibits said moving operation of said operation member; and a second stopper integrally connected to said first stopper, said second stopper being moved relative to said lock plate and positioned out of a path for swinging of said lock plate to enable said lock plate to swing from said engagement position to said disengagement position when said first stopper is placed at said allowance position, said second stopper being positioned in the swinging path of said lock plate to inhibit said lock plate from swinging from said engagement position to said disengagement position when said first stopper is placed at said inhibition position.

12. A buckle device according to claim 11, wherein said operation member is supported on said buckle case so as to be able of effect movement along a direction of insertion of said tongue plate, the allowance position of said first stopper being set out of a path for movement of said operation member, and said inhibition position being set in a path for movement of said operation member.

13. A buckle device according to claim 12, wherein said first stopper has an operational portion located outside said buckle case, and said first stopper is supported on said buckle case so as to be able to rotate to said allowance position or said inhibition position by a rotational operation of said operational portion.

14. A buckle device according to claim 13, wherein said lock plate has a recess operably associated in the direction of swinging of said lock plate with said second stopper when said first stopper is placed in said allowance position, whereby said second stopper is positioned out of the swinging path of said lock plate.

15. A buckle device according to claim 12, wherein said first stopper has an operational portion located outside said buckle case, and said first stopper is supported on said buckle case so as to be able to rotate to said allowance position or said inhibition position by an operation of sliding said operational portion in a direction generally perpendicular to the direction of insertion of said tongue plate and generally parallel to the plane of the insertion path.

16. A buckle device according to claim 15, wherein said lock plate has a projection, and said second stopper has a contact portion which is positioned out of a path for swinging of said projection of said lock plate to allow said lock plate to swing from said engagement position to said disengagement position when said first stopper is placed in said allowance position, and which is positioned in the path for swinging of said projection of said lock plate to inhibit said lock plate from swinging from said engagement position to said disengagement position when said first stopper is placed in said inhibition position.

17. A buckle device according to claim 11, wherein said operation member is arranged in such a manner that said operation member effects said movement in the direction perpendicular to the direction of insertion of said tongue plate when operated by being pressed so as to move into said buckle case through an opening formed in said buckle case.

18. A buckle device according to claim 17, wherein said first stopper is formed of a lid which opens said opening to allow said operation of pressing said operation member when placed in said allowance position, and which closes said opening to inhibit said operation of pressing said operation member when placed in said inhibition position.

19. A buckle device according to claim 18, wherein said second stopper has an extension which extends from said lid, which is positioned out of a path for swinging of said lock plate when said lid is placed in said allowance position, and which is positioned in the path for swinging of said lock plate when said lid is placed in said inhibition position.

* * * * *